US006193396B1

(12) United States Patent
Winger et al.

(10) Patent No.: US 6,193,396 B1
(45) Date of Patent: Feb. 27, 2001

(54) HANGING HOLDER FOR DECORATIONS

(75) Inventors: Timothy M. Winger, Lancaster; Max J. Kessler, Ephrata; Matthew P. Keys-Ludwig, Lancaster, all of PA (US)

(73) Assignee: Novelty Manufacturing Co., Lancaster, PA (US)

( * ) Notice: Subject to any disclaimer, the term of this patent is extended or adjusted under 35 U.S.C. 154(b) by 0 days.

(21) Appl. No.: 09/487,199

(22) Filed: Jan. 19, 2000

(51) Int. Cl.[7] ..... F21V 35/00
(52) U.S. Cl. ..... 362/392; 362/810; 362/397
(58) Field of Search ..... 362/161, 382, 362/392, 397, 810; 248/689, 692, 27.8, 205.5, 206.3, 534, 536, 537

(56) References Cited

U.S. PATENT DOCUMENTS

D. 159,658 * 10/1997 McCallum et al. ..... 248/27.8
4,839,784 6/1989 Lin ..... 362/393
5,199,781 4/1993 Sweeny ..... 362/145
5,422,803 * 6/1995 Kilgore ..... 362/392
5,678,793 * 10/1997 Hill ..... 248/206.3

* cited by examiner

*Primary Examiner*—Y. Quach
(74) *Attorney, Agent, or Firm*—Martin Fruitman

(57) ABSTRACT

The apparatus is a holder to mount decorations or an electric candle either inside or outside a window. A main shelf structure has extensions from both its horizontal surface and an attached vertical back section. The extensions from the vertical back section angle back to the rear, then rise vertically again, and the uppermost vertical extensions have suction cups to attach the entire structure to an adjacent window. An extension from the front edge of the horizontal main shelf angles downward, and the main shelf and the front angled extension have several holes with which to attach decorations, such as evergreen branches, in front of a vertically extending decoration such as a candle. The vertically extending decoration is mounted in "V" cuts within holding shelves which are attached to the vertical back section.

10 Claims, 1 Drawing Sheet

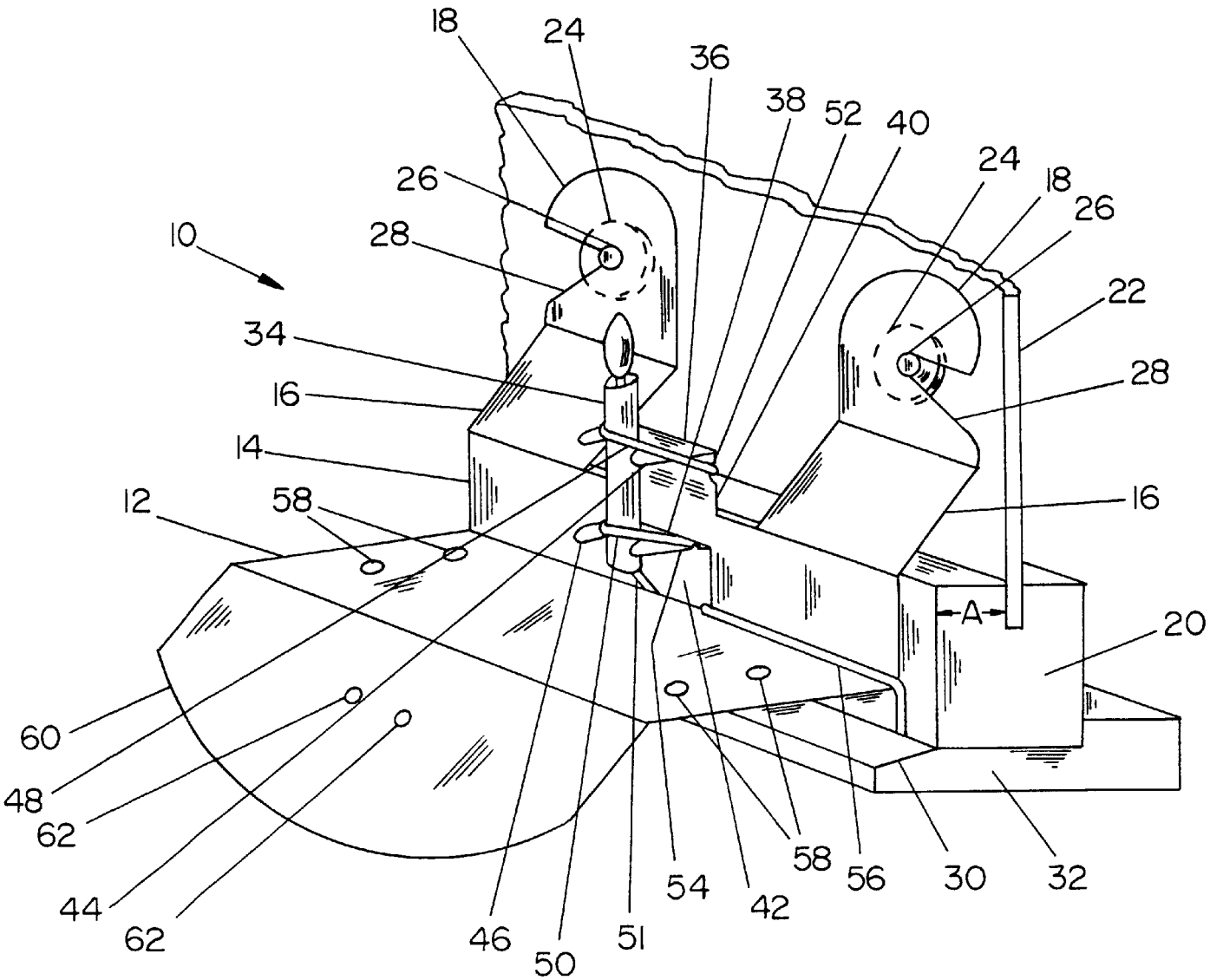
10
12
14
16
18
20
22
24
26
28
30
32
34
36
38
40
42
44
46
48
50
51
52
54
56
58
60
62
A

HANGING HOLDER FOR DECORATIONS

BACKGROUND OF THE INVENTION

This invention deals generally with decoration holders, and more specifically with a holder to securely hold an electric candle or other decorations at a window sill.

It is becoming more and more common to see electric candles displayed in windows, not only during the Christmas season, but, in some geographic regions, all year round. These electric candles typically include a base which is essentially an inverted cone, and are simply set upon the interior window sill. This arrangement is not only somewhat unstable, but it limits additional decorations associated with the candle to such things as simple ribbons tied around the candle. Furthermore, the instability of such candles make them difficult to use on the outside of windows.

It would be quite advantageous to have a very stable support for installing an electric candle adjacent to a window, or for attaching other significant decorations, such as Christmas greenery, and even installing the decorations outside the window.

SUMMARY OF THE INVENTION

The present invention provides a decoration holder which securely holds a candle or other vertically oriented decoration, such as a stick for a flag, either inside or outside a window, and also permits the display of other decorations adjacent to or instead of the vertically oriented decoration.

The invention holds such an electric candle and other decorations at a window sill, but does not depend upon the sill for support, so it can be used with very narrow sills, or even installed high on the window. The decoration holder is constructed as a horizontal main shelf with a vertical section attached to the back of the shelf and extensions from both the front edge of the main shelf and the top edge of the vertical back section.

Two back extensions rise up at an angle from the vertical back section and each has a second section which rises vertically again. This permits the decoration holder to fit loosely around the bottom window sash. The uppermost vertical sections of the rear extensions have suction cups to attach to the adjacent window, so that the decoration holder actually hangs from the window as opposed to sitting on the window sill.

The front extension extends downward at an angle to the main shelf, and both the shelf and the extension have several holes. The holes make it easy to attach other decorations, such as evergreen branches, in front of a candle or some other vertically extending decoration by the use of string or twist ties.

The vertically extending decoration, such as a candle or a flag stick is mounted by fitting it into "V" slots in two small horizontal holding shelves extending forward from the vertical section at the back of the shelf, and small notches are formed in the holding shelves to capture twist ties or rubber bands which hold the vertically oriented decoration in the "V" slots.

The electrical wires from a candle or other electrified decoration pass through a cutout in the vertical back section formed when one of the small holding shelves is cut out of the vertical section.

The entire assembly, except for the suction cups and the decorations themselves, can be made from a single sheet of material. The sheet is simply bent into the appropriate shape, after the horizontal holding shelves with their "V" slots, holes for decorations, and slots for the suction cups are formed into the sheet.

The decoration holder can therefore be made quite inexpensively, but it provides a safe and secure holder for use indoors or out to hold an electric candle or other seasonal or event decorations.

BRIEF DESCRIPTION OF THE DRAWING

The FIGURE is a perspective view of the preferred embodiment of the invention shown as it would hang from a window.

DETAILED DESCRIPTION OF THE INVENTION

The FIGURE is a perspective view of the preferred embodiment of hanging decoration holder 10 of the invention formed as shelf 12 with vertical back section 14.

Back section 14 is oriented as a vertical plane to which angular extensions 16 are attached. Vertical extensions 18 are attached to angular extensions 16 and angular extensions 16 are oriented at angles to the plane of back section 14 and vertical extensions 18, so that vertical extensions 18 are offset from back section 14 by a distance sufficient to surpass the thickness A by which window sash 20 protrudes beyond window 22. The angles used are typically between 20 and 40 degrees.

Suction cups 24 are attached to vertical extensions 18 by conventional means such as holes 26 and slots 28 so that the cup portions of suction cups 24 are located between vertical extensions 18 and window 22, face away from vertical extensions 18 on the surfaces of extensions 18 opposite from angular extension 16, and can be attached to window 22. As shown in the FIGURE, suction cups 24 therefore support hanging decoration holder 10 so that vertical extensions 18 are parallel to the plane of window 26 and are in an essentially vertical orientation. It should also be noted that suction cups 24 can support hanging decoration holder 10 above top edge 30 of window sill 32 and that hanging decoration holder 10 requires no support from window sill 32.

An electric candle 34 or any other vertically oriented decoration can be held within hanging decoration holder 10 by a very simple structure and can easily be installed or removed. Holding shelves 36 and 38 are formed by cutting them out of and bending them out of back wall 14. Holding shelf 36 has a short vertical extension 40 to raise it farther above holding shelf 38, and shelf 38 leaves cut-out hole 42. Shelves 36 and 38 are formed with "V" slots 44 and 46, respectively, which are aligned so that candle 34 is oriented vertically. Candle 34 or any other vertically oriented decoration is held within "V" slots 44 and 46 by the simple means of string, twist ties, or rubber bands 48 and 50. Notch 52 is formed into vertical extension 40, and notch 54 is formed in holding shelf 38 to hold such devices as rubber bands 48 and 50 in place. When an electric candle or other electrical device is used, its power cord 51 can be passed to the rear of decoration holder 10 through cut-out hole 42.

As an aid to maintaining decoration holder 10 in place, for instance, when it is outside and subjected to wind, cord 56 can also be threaded through cut-out hole 42 and around a portion of back section 14, and then both ends of cord 56 can be captured between sash 20 and sill 32 to securely anchor decoration holder 10.

Hanging decoration holder 10 is also constructed to hold other decorations such as evergreen branches, ribbons, or other holiday or event decorations. To facilitate holding such decorations, holes 58 can be formed within main shelf 12, and front angled extension 60 can be included and attached to main shelf 12. Holes 62 can then be formed in front angled extension 60. Decorations can then easily be attached in front of candle 34 by simply using string or twist ties through holes 58 and 62.

One particular advantage of the design of the preferred embodiment of hanging decoration holder 10 which is shown in the FIGURE is the ability to make it from one simple sheet of either plastic or metal. As can be appreciated from the FIGURE and the preceding description, all of the bends in the sheet which forms decoration holder 10 are quite simple, and none are greater than 90 degrees. Furthermore, the holes are quite easy to punch in thin sheet material, and the one internal part, holding shelf 38 requires only three cuts in the material. It is also quite practical to manufacture the invention by injection molding it of plastic. When that process is used it is a simple matter to omit large sections of the planar surfaces such as main shelf 12 and front extension 60 to save material and to add gussets for increased strength.

The invention thereby furnishes a very easily constructed decoration holder which can hang either inside or outside a window, and to which other decorative items can easily be attached.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, more or fewer holes 58 and 62 can be used on the invention and angled front extension 60 can be entirely omitted. Furthermore, shelves 36 and 38 can be enlarged and furnished with additional "V" slots, so that more than one vertically oriented decoration can be mounted on decoration holder 10. Moreover, the angles between angular extensions 16 and back section 14 and vertical extensions 18 can also vary over the entire range of 0 degrees, yielding a planar back section including vertical extensions 18 and suction cups 24, to 90 degrees, making angular extensions 16 horizontal.

What is claimed as new and for which letters patent of the U.S. are desired to be secured is:

1. A decoration holder comprising:

at least one vertical extension with at least one suction cup attached to the vertical extension so that the cup portion of the suction cup protrudes from one surface of the vertical extension and can hold the vertical extension against an adjacent surface;

a main shelf attached to a vertical back section, at least one angular extension connecting the back section to the vertical extension, and the main shelf extending away from the vertical extension in a direction opposite from the suction cups; and at least two holding shelves attached to the back section and protruding from the back section so that the holding shelves are located above the main shelf, with each holding shelf including a slot into which a vertically oriented decoration can be inserted and with one holding shelf located below the other with the slots in the holding shelves vertically aligned.

2. The decoration holder of claim 1 further including each angular extension oriented transverse to the vertical extension so that the angular extension extends away from the vertical extension in a direction opposite from the suctions cups, and the back section attached to the main shelf is attached to the angular extension at a location remote from the vertical extension.

3. The decoration holder of claim 1 wherein the slots in the holding shelves are "V" shaped.

4. The decoration holder of claim 1 further including at least one hole in the main shelf.

5. The decoration holder of claim 1 further including a front extension attached to the main shelf and extending away from the back section and at an angle to the main shelf.

6. The decoration holder of claim 1 further including a front extension attached to the main shelf and extending away from the back section and at an angle to the main shelf with at least one hole formed in the front extension.

7. The decoration holder of claim 1 wherein said vertically oriented decoration includes an electric candle held within the slots in the holding shelves.

8. The decoration holder of claim 1 wherein the holding shelf is formed from a portion of the back section attached to the main shelf.

9. The decoration holder of claim 1 wherein the vertical extensions, the angular extensions, the back section, the main shelf, and the holding shelves are constructed from a single sheet of material.

10. The decoration holder of claim 1 further including a cord holding the decoration holder and captured between a window sash and a window frame.

* * * * *